US005966687A

United States Patent [19]

Ojard

[11] Patent Number: 5,966,687

[45] Date of Patent: Oct. 12, 1999

[54] VOCAL PITCH CORRECTOR

[75] Inventor: Eric Ojard, San Francisco, Calif.

[73] Assignee: C-Cube Microsystems, Inc., Milpitas, Calif.

[21] Appl. No.: 08/998,924

[22] Filed: Jul. 11, 1997

Related U.S. Application Data

[63] Continuation of application No. 08/777,444, Dec. 30, 1996, abandoned.

[51] Int. Cl.[6] ..... G10L 3/02

[52] U.S. Cl. ..... 704/207; 704/270

[58] Field of Search ..... 704/270, 200, 704/207, 208, 209

[56] References Cited

U.S. PATENT DOCUMENTS

| | | | |
|---|---|---|---|
| 3,995,116 | 11/1976 | Flanagan | 395/2.76 |
| 4,241,235 | 12/1980 | McCanney | 704/200 |
| 4,246,617 | 1/1981 | Portnoff | 360/32 |
| 4,342,104 | 7/1982 | Jack | 367/132 |
| 4,566,117 | 1/1986 | Suckle | 395/2.77 |
| 4,624,012 | 11/1986 | Lin et al. | 395/2.7 |
| 4,852,168 | 7/1989 | Sprague | 395/2.77 |
| 4,969,192 | 11/1990 | Chen et al. | 395/2.28 |
| 5,163,110 | 11/1992 | Arthur et al. | 395/2.09 |
| 5,327,521 | 7/1994 | Savic et al. | 395/2.81 |
| 5,528,726 | 6/1996 | Cook | 395/2.7 |
| 5,577,160 | 11/1996 | Hosom et al. | 395/2.18 |

*Primary Examiner*—Richemond Dorvil
*Attorney, Agent, or Firm*—Proskauer Rose LLP

[57] ABSTRACT

A method and system are provided for correcting a pitch of a human generated vocal signal. A human vocal signal is received at a first input. A reference signal having correct pitch is received at a second input. The pitch of the human vocal signal is then corrected by shifting the pitch of the human vocal signal to match the pitch of the reference signal, e.g., using pitch shifter circuitry.

12 Claims, 2 Drawing Sheets

VOCAL PITCH CORRECTOR

RELATED APPLICATION

This is a continuation application of U.S. patent application Ser. No. 08/777,444, entitled VOCAL PITCH CORRECTOR, filed Dec. 30, 1996 now abandoned.

FIELD OF THE INVENTION

The present invention pertains to processing audio signals and in particular to correcting an incorrect pitch of a human generated voice signal.

BACKGROUND OF THE INVENTION

A "karaoke" device is a digital storage media playback device, typically a laser disc player or CD-ROM drive, used for amusement purposes. The karaoke device plays a musical accompaniment to a song, but not the vocal accompaniment (or at least not the lead vocal accompaniment). Usually, this is achieved by recording a specific arrangement of the song that lacks one or more vocal accompaniments. A selected song is played back and an individual provides a live version of the vocal accompaniment. Typically, the individual providing the vocal accompaniment is an amateur singer who has difficulty maintaining correct pitch for the vocal accompaniment. A video presentation, including the text of the lyrics, is also typically generated by the digital storage media playback device from the digital storage medium.

In the karaoke art, processors exist for correcting the vocal pitch of an amateur signer. Typically, these processors employ one of two approaches whereby the singer's pitch is corrected to the nearest semitone or to the nearest note within a given scale. Both of these techniques have disadvantages. In the "nearest semitone" approach, the singer's pitch must be within a half semitone of the correct pitch. However, this is difficult for an amateur singer to achieve. In this approach, if the signer's pitch is off by more than a half semitone, the correction process tends to produce a vocal signal that deviates more from the correct pitch than the original uncorrected vocal signal. In the "nearest tone" approach, the singer must specify the scale in which the singer will sing. This is generally impractical in the context of an amusement device for amateurs. Moreover, this presents a problem if the vocal accompaniment changes key during the song. Furthermore, the pitch of the singer's vocal signal must still be closer to the correct note than any other note in the scale in order to produce a vocal signal that is closer to the correct pitch than more deviant. Again, this is not always the case for an amateur singer.

It is an object of the present invention to overcome the disadvantages of the prior art.

SUMMARY OF THE INVENTION

This and other objects are achieved according to the present invention. According to one embodiment, a method and system are provided for correcting a pitch of a human generated voice signal. A human vocal signal is received at a first input. A reference signal having correct pitch is received at a second input. The pitch of the human vocal signal is then corrected by shifting the pitch of the human vocal signal to match the pitch of the reference signal, e.g., using pitch shifter circuitry.

Illustratively, the reference signal is a second human voice signal produced by a professional singer with correct (or humanly perceptibly correct) pitch. The second human voice signal may be generated in real time by a professional singer who signs along with the singer who produces the to-be-corrected human voice signal. Alternatively, the reference signal may be reproduced by a digital storage media playback device. In the latter embodiment, the reference signal may be recorded on a channel of the same digital storage medium on which a song (sung by the singer who produces the to-be-corrected human voice signal) is recorded.

DETAILED DESCRIPTION OF THE INVENTION

Figure 1:
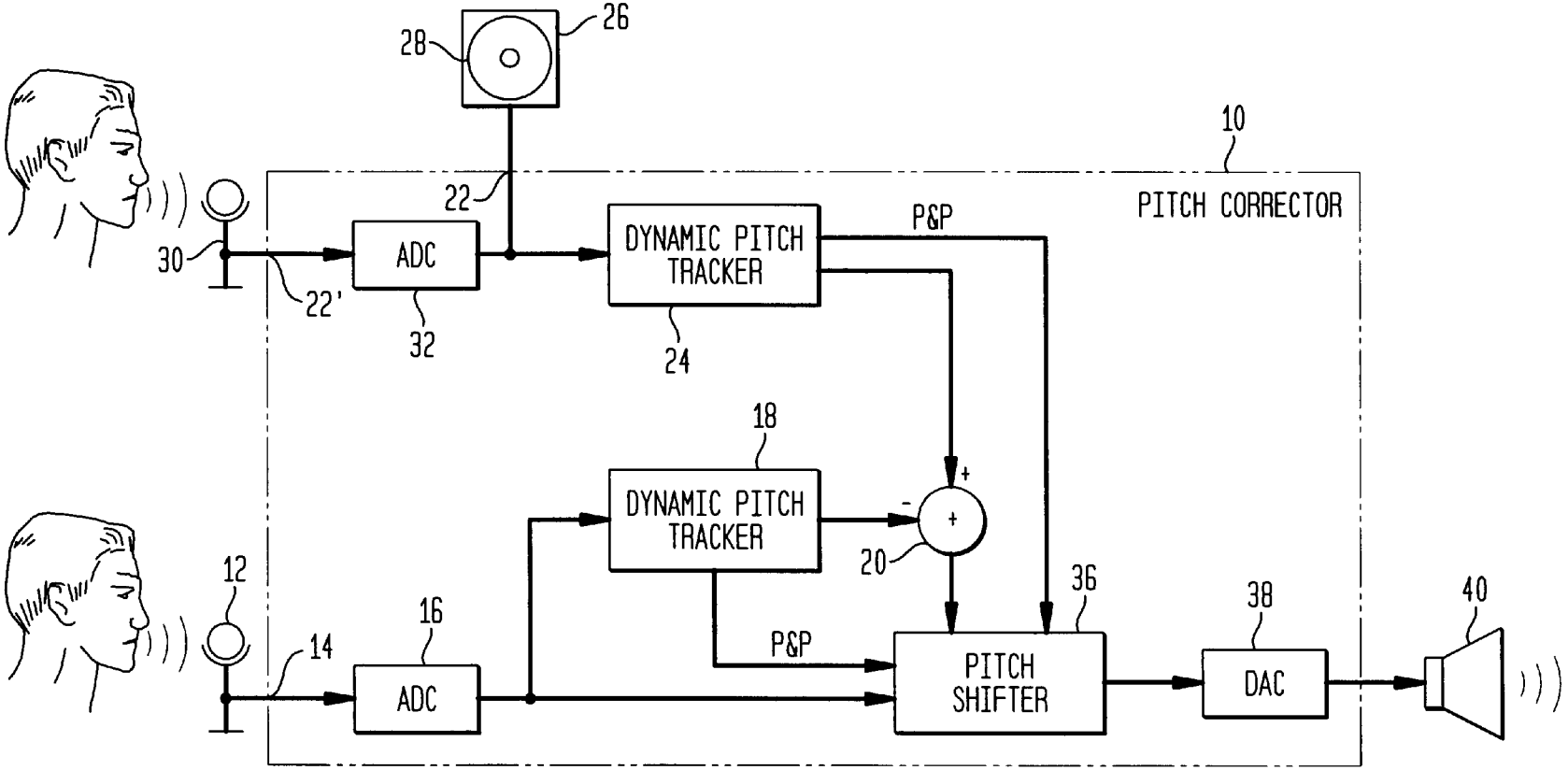
FIG. 1 shows a vocal pitch corrector circuit according to an embodiment of the present invention.

FIG. 1 depicts a vocal pitch corrector circuit 10 according to an embodiment of the present invention. A singer produces a vocal sound which is received at a microphone 12. The microphone 12 produces a human generated to-be-corrected vocal signal, corresponding to the received vocal sound. The to-be-corrected vocal signal produced by the microphone is fed to a first input 14. The to-be-corrected vocal signal received at the first input 14 is fed to an analog to digital converter (ADC) 16. The ADC 16 samples the to-be-corrected vocal signal at a particular rate, e.g., 44.1 kHz, to produce digital vocal sample data (e.g., of eight bits/sample) of a digitized to-be-corrected vocal signal. The digitized to-be-corrected vocal signal thus produced is inputted to a first dynamic pitch tracker circuit 18. The first dynamic pitch tracker circuit 18 dynamically determines the pitch of the digitized to-be-corrected vocal signal and outputs a signal indicating the determined pitch to an adder 20.

A reference signal is received via a second input 22 at a second dynamic pitch tracker circuit 24. Illustratively, the reference signal is also a digital human generated vocal signal produced from a vocal sound generated by a professional singer. As shown, the reference signal may be reproduced by a digital storage media player (disc player, DVD player, etc.) 26 from a digital storage medium (disc, DVD, etc.) 28. Alternatively, a professional singer produces vocal sounds in real-time contemporaneously as the amateur singer produces the to-be-corrected vocal sounds. The vocal sounds of the professional singer are received at a second microphone 30 which produces a second human generated vocal signal. The second human generated vocal signal is received via second input 22' and is sampled in a second ADC 32.

The reference signal is generated in a fashion such that it has the correct pitch (or humanly perceptibly correct pitch) relative to the to-be-corrected human generated vocal signal. The reference signal is received at a second dynamic pitch tracker circuit 24. The second dynamic pitch tracker circuit 24 outputs a signal indicating the pitch of the reference signal to a second input of the adder 20. The adder 20 forms an error signal by subtracting the pitch of the to-be-corrected vocal signal from the pitch of the reference signal.

As shown, the dynamic pitch tracker circuits 18 and 24 can optionally output enabling or disabling signals "P&P" to the pitch shifter 36. The dynamic pitch tracker circuit 18 or 24 outputs a disabling signal to the pitch shifter 36 if the to-be-corrected vocal signal or reference signal received at the dynamic pitch tracker circuit 18 or 24, respectively, is not both present and periodic. The purpose of the enable signals is explained in greater detail below.

The error signal outputted from the adder is inputted as a control input to a pitch shifter 36. The pitch shifter 36 also receives the samples of the to-be-corrected vocal signal. In response, the pitch shifter 36 corrects the pitch of the to-be-corrected vocal signal by shifting its pitch to remove the error indicated in the error signal. The pitch-corrected vocal signal thus produced is outputted from the pitch shifter 36 to a digital to analog converter (DAC) 38. The DAC 38 converts the pitch-corrected vocal signal to analog form. The pitched-corrected vocal signal may then be combined with a musical accompaniment of a song and outputted to a loudspeaker 40.

In the pitch corrector 10, the individual circuits may be combined to reduce the hardware requirement of the pitch corrector 10. For example, the dynamic pitch tracker circuits 18, 24, adder 20 and pitch shifter 36 can be combined into a single circuit or digital signal processor (DSP) executing suitable software so as to operate in the above-described fashion.

Figure 2:
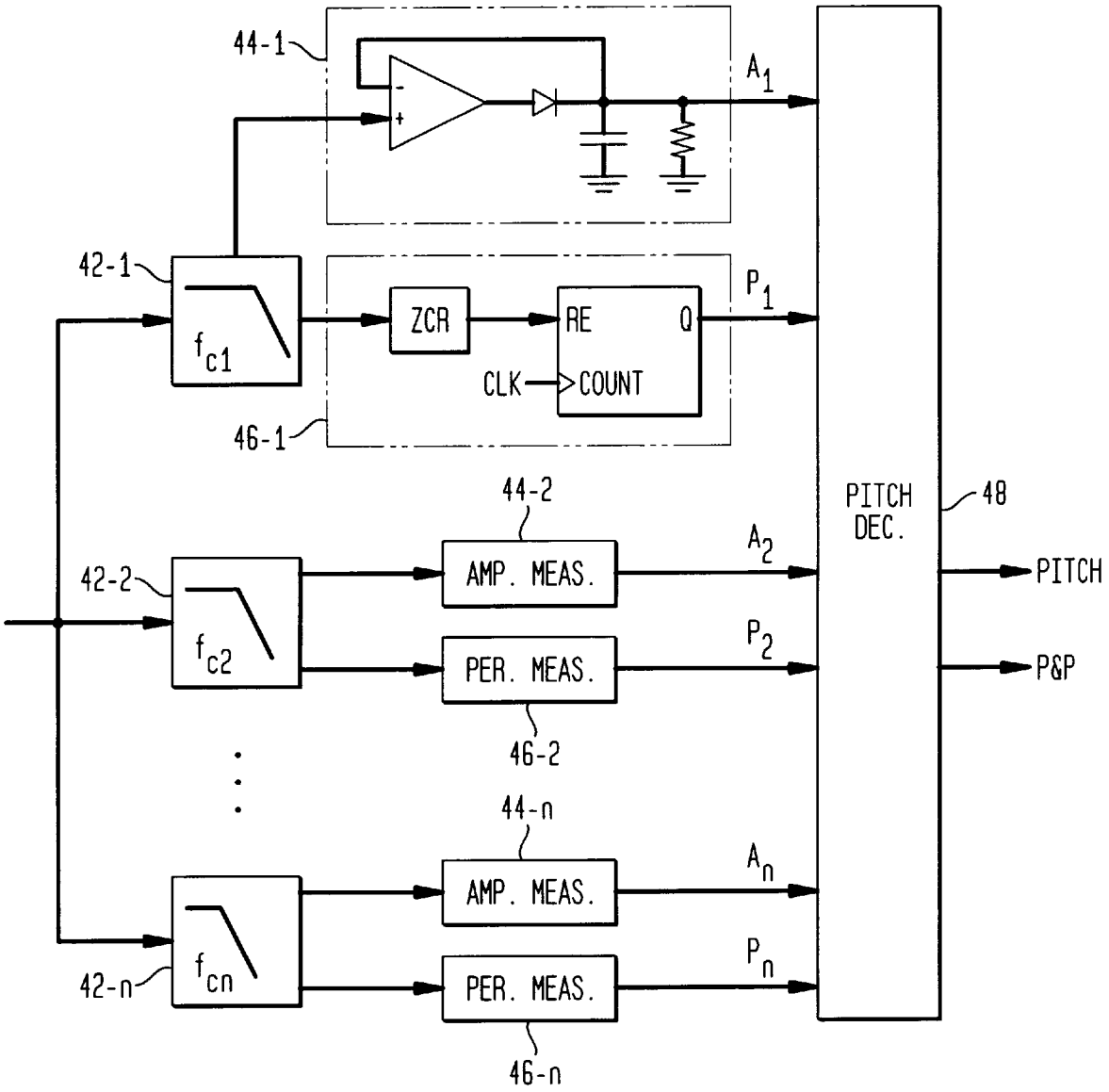
FIG. 2 shows an illustrative dynamic pitch tracker circuit.

FIG. 2 shows an exemplary dynamic pitch tracker 18 or 24. See Kuhn, *A Real-Time Pitch Recognition Algorithm for Music Applications,* COMP. Music J., vol. 13, no. 4, p.65–71 (1990). However, any ad hoc dynamic pitch or period identification technique may be used in the pitch corrector 10 (FIG. 1). An inputted signal, such as the to-be-corrected vocal signal, is received at multiple low pass filters **42-*i* for i=1, 2, . . . , n. Each filter 42-*i* has a respective cut-off frequency $f_{c1}$, $f_{c2}$, . . . , $f_{cn}$, which cut-off frequencies illustratively are spaced at half octave intervals. The output of each filter 42-*i* is received at a corresponding amplitude measurer circuit 44-*i*, for i=1, 2, . . . , n and a corresponding period measurer circuit 46-*i*, for i=1, 2, . . . , n. An exemplary amplitude measurer 44-1 is shown as a rectifier circuit. An illustrative period measurer 46-1 is shown as a zero crossing detector and counter circuit. The amplitude measurers 44-*i* each output a respective amplitude level $A_1, A_2, \ldots, A_n$. The period measurers 46-*i* each output a respective period length $P_1$, $P_2$, . . . , $P_n$ (e.g., a number of clock pulses between successive zero crossings, which clock pulses may be synchronized to the sample clock of the ADC 16 of FIG. 1). The signals $A_1, A_2, \ldots, A_n$ and $P_1, P_2, \ldots, P_n$ are received at a pitch decision circuit 48. The pitch decision circuit 48 may determine if the input (to-be-corrected or reference) signal is present by processing the amplitude signals $A_i$. If present, the decision circuit 48 scans each period length signal $P_i$ (or $1/P_i$) in the order of lowest to highest cut-off frequency $f_{ci}$ of the filters 42-$_i$. As each signal $P_i$ is scanned, the pitch decision circuit 48 determines if the period length signal $P_i$ is appropriate for the filter 42-*i* to which it corresponds (i.e., within the half octave passband of the filter 42-*i*). If so, the pitch decision circuit 48 outputs the signal $P_i$ as the identified pitch. If the currently scanned signal $P_i$ is not appropriate for the filter 42-*i* to which it corresponds, the pitch decision circuit 48 examines the signal $P_{i'}$ of the filter 42-*i'*** with the next highest cut-off frequency $f_{ci'}$.

Illustratively, each dynamic pitch tracker 18, 24 also ensures that both the to-be-corrected vocal signal and the reference signal are both present and periodic. The pitch shifter 36 should only be enabled when this condition is true for both signals. Thus, the pitch shifter 36 corrects the pitch of the to-be-corrected vocal signal only at times when both the to-be-corrected vocal signal and reference signal are both present and periodic.

According to one technique for determining whether or not the inputted (to-be-corrected vocal or reference) signal is present, the dynamic pitch shifter 18 or 24 can simply determine the power of the inputted signal over successive short intervals and compare the power thus determined to a predefined threshold. This determination can be made, for example, by the pitch decision circuit 48. However, any one of a number of ad hoc techniques can be used. Likewise, a number of ad hoc techniques can be used to determine whether or not the inputted (to-be-corrected vocal or reference) signal is periodic. According to one technique, the variation in period over the last N periods is determined. If the variation exceeds a certain threshold, the inputted signal is deemed aperiodic. For example, if:

$$\frac{L_{\max} - L_{\min}}{L_{\max}} \geq L_{threshold}$$

the inputted (to-be-corrected vocal or reference) signal is aperiodic where:

$L_{\max}$ is the maxium period length over the last $N$ periods, $L_{\min}$ is the minimum period length over the last $N$ periods, $N$ is an integer, e.g., $N = 10$, and $L_{threshold}$ is some threshold, e.g., $L_{threshold} = 0.1$.

Again, this determination can be made by the pitch decision circuit 48. Illustratively, if the inputted (to-be-corrected vocal or reference) signal is both present and periodic, the pitch decision circuit 48 of the dynamic pitch tracker 18 or 24 outputs an enabling signal "P&P" to the enable input of the pitch shifter circuit 36. The pitch shifter circuit 36 is only enabled when it receives the enabling signal P&P from both pitch tracker circuits 18 and 24.

The disabling of the pitch shifter 36 unless both the to-be-corrected vocal signal and reference signal are present and periodic provides two advantages. First, no pitch shifting occurs if the to-be-corrected vocal signal and reference signal are not synchronized (for example, if the amateur singer sings when the reference signal is not present). Second, the disablement prevents pitch shifting on sibilant sounds (i.e., the sounds "sh", "ch", "s", "z", "zh", "j", etc.).

If the pitch corrector 10 (FIG. 1) is implemented using a DSP, then the pitch shifter 36 can be implemented as a process executed by the DSP. K. Lent, *An Efficient Method for Pitch Shifting Digitally Sampled Sound,* COMP. Music J., vol. 14, no. 3, p. 60–71 (1991) discusses a general pitch shifter process for shifting the pitch of an input signal according to a predetermined fixed factor. This particular process is especially appropriate for voice because it preserves the formant of the pitch shifted signal. However, this reference does not adequately explain how to perform pitch tracking. Nevertheless, the above-described dynamic pitch tracking technique can be used for this. The pitch shifter process disclosed in the Lent reference can be modified according to the invention as follows. Windows of samples corresponding to selected periods of the to-be-corrected vocal signal are extracted. The extracted windows of samples are then reconstructed at a rate corresponding to the identified period of the reference signal. In other words, the pitch shifting of the to-be-corrected vocal signal depends on a function of the dynamically varying pitches of the to-be-corrected vocal signal and the reference signal. The pitch of the reconstructed signal matches the pitch of the reference signal and may be outputted as the corrected vocal signal. If such a pitch shifter process is used, the dynamic pitch trackers 18 and 24 are also preferably implemented as processes executed by the DSP and are integrated into the pitch shifter process.

In a variation, the pitch shifter 36 can be used to correct the pitch of the to-be-corrected vocal signal to a particular harmonic pitch of the reference signal, or the nearest harmonic of the reference signal, rather than the precise pitch of the reference signal. This may be desired for a number of reasons. For instance, the singer producing the to-be-corrected vocal signal might not be able to sing in the key of the reference signal. Alternatively, it may be desired to correct and shift the to-be-corrected vocal signal to a certain harmonic of the reference signal for aesthetic purposes. The pitch shifter 36 can be easily modified such that it shifts the pitch of the to-be-corrected vocal signal to the nearest note harmonically related to the reference pitch. U.S. Pat. No. 5,301,259 discusses the generation of a harmony from an input signal.

Finally, the above-discussion is intended to be merely illustrative of the invention. Numerous alternative embodiments may be devised by those having ordinary skill in the art without departing from the spirit and scope of the following claims.

The claimed invention is:

1. A method for correcting a pitch of a to-be-corrected human generated vocal signal comprising the steps of:

(a) receiving a to-be-corrected human vocal signal;

(b) determining an unknown pitch of the received to-be-corrected human vocal signal and generating a dynamically varying pitch signal which indicates the dynamically varying determined pitch of the to-be-corrected human vocal signal;

(c) receiving a dynamically varying reference pitch signal which depends on the dynamically varying pitch of a reference signal with correct pitch;

(d) generating an error signal between the pitch signal and the reference pitch signal; and (e) correcting a pitch of the received to-be-corrected human vocal signal by shifting only the pitch of the to-be-corrected human vocal signal based on the error signal to match a pitch of the reference signal while preserving a formant of the to-be-corrected human vocal signal.

2. The method of claim 1 further comprising the step of:

(f) receiving a second human vocal signal as the reference signal.

3. The method of claim 2 further comprising the step of:

(g) contemporaneously receiving the to-be-corrected human vocal signal and the reference signal form microphones.

4. The method of claim 1 further comprising the step of:

(f) reproducing the reference signal from a recording.

5. The method of claim 1 further comprising the step of:

(f) shifting the pitch of the to-be-corrected human vocal signal to a note that is harmonically related to the pitch of the reference signal.

6. The method of claim 1 further comprising the step of:

(f) performing the step (e) only at times when both the to-be-corrected human vocal signal and the reference signal are both present and periodic.

7. Apparatus for correcting a pitch of a to-be-corrected human generated vocal signal comprising:

(a) a first input for receiving a to-be-corrected human vocal signal;

(b) a second input for receiving a dynamically varying reference pitch signal which depends on the dynamically varying pitch of a reference signal with correct pitch;

(c) tracker circuitry for determining an unknown pitch of the received to-be-corrected human vocal signal and generating a dynamically varying pitch signal which indicates the dynamically varying determined pitch of the to-be-corrected human vocal signal;

(d) an adder connected to the tracker circuitry for generating an error between the pitch signal and the reference pitch signal; and (e) circuitry connected to the first and second inputs for correcting a pitch of the to-be-corrected human vocal signal by shifting only the pitch of the to-be-corrected human vocal signal to match a pitch of the reference signal while preserving a formant of the to-be-corrected human vocal signal.

8. The apparatus of claim 7 wherein a second human vocal signal is received as the reference signal.

9. The apparatus of claim 8 further comprising:

(f) a first microphone connected to the first input for outputting the to-be-corrected human vocal signal, and (g) a second microphone connected to the second input for outputting the reference signal.

10. The apparatus of claim 7 further comprising:

(f) a digital stored media player for outputting the reference signal from a recording.

11. The apparatus of claim 7 wherein the circuitry shifts the to-be-corrected human vocal signal to a note that is harmonically related to the pitch of the reference signal.

12. The apparatus of claim 7 further comprising:

(f) enable circuitry connected to the first and second inputs for enabling the circuitry to correct the pitch of the to-be-corrected human vocal signal only at times when both the to-be-corrected human vocal signal and the reference signal are both present and periodic.

* * * * *